United States Patent [19]

Endo et al.

[11] Patent Number: 4,574,398

[45] Date of Patent: Mar. 11, 1986

[54] ESCAPE GLOVES

[76] Inventors: Kazuya Endo; Hiroko Ito, both of No. 22-3, Motoshiro-cho, Fujimiya-shi, Shizuoka-ken, Japan

[21] Appl. No.: 712,533

[22] Filed: Mar. 18, 1985

[51] Int. Cl.[4] ..... A41D 19/00

[52] U.S. Cl. ..... 2/159; 2/167; 182/5

[58] Field of Search ..... 2/159, 160, 161 R, 161 A, 2/167, 164, 16, 17, 70; 182/5

[56] References Cited

U.S. PATENT DOCUMENTS

| | | | |
|---|---|---|---|
| 2,083,935 | 6/1937 | Arnold | 2/161 R |
| 2,302,875 | 11/1942 | Lykins | 2/159 |
| 2,610,326 | 9/1952 | Sabin | 2/161 R |
| 2,710,970 | 6/1955 | Kennedy | 2/159 |
| 2,728,082 | 12/1955 | Slimovitz | 2/167 |
| 3,108,285 | 10/1963 | Turnidge et al. | 2/161 R |
| 3,416,158 | 12/1968 | Kulman | 2/161 R |
| 3,548,413 | 12/1970 | Jackson | 2/161 R |
| 4,032,990 | 7/1977 | Mandlman | 2/161 |

*Primary Examiner*—Ronald Feldbaum

*Attorney, Agent, or Firm*—Hill, Van Santen, Steadman & Simpson

[57] ABSTRACT

An escape glove comprising a glove having a palm portion with a heat-insulating layer thereon, together with a heat- and wear-resistant elastic guide member attached to the palm portion, the elastic guide member having a lateral groove therein proportioned to receive an escape rope therein. The elastic member is located substantially at the center of the heat-insulating sheet layer and permits the user to control relative movement between the rope and the guide member by exerting varying amounts of pressure by his hand movement.

7 Claims, 2 Drawing Figures

ESCAPE GLOVES

BACKGROUND OF THE INVENTION

Field of the Invention

The present invention is in the field of glove constructions especially adapted for use in connection with escape ropes for lowering persons to the ground in times of emergency. The escape glove provides an elastic guide member which cooperates with the rope to enable controlled descent of the person along the rope without burning his hands due to friction.

SUMMARY OF THE INVENTION

The present invention provides an escape glove comprising a glove body composed of cloth or other material and having a palm portion which includes a heat-insulating sheet layer. A heat- and wear-resistant elastic guide member is attached to the heat-insulating sheet layer and has a lateral groove therein proportioned to receive an escape rope therein. The elastic member is located substantially at the center of the heat-insulating sheet layer and fits the rope sufficiently snugly so that controlled relative movement of the rope through the guide member occurs by application of pressure by the hand movement of the wearer.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
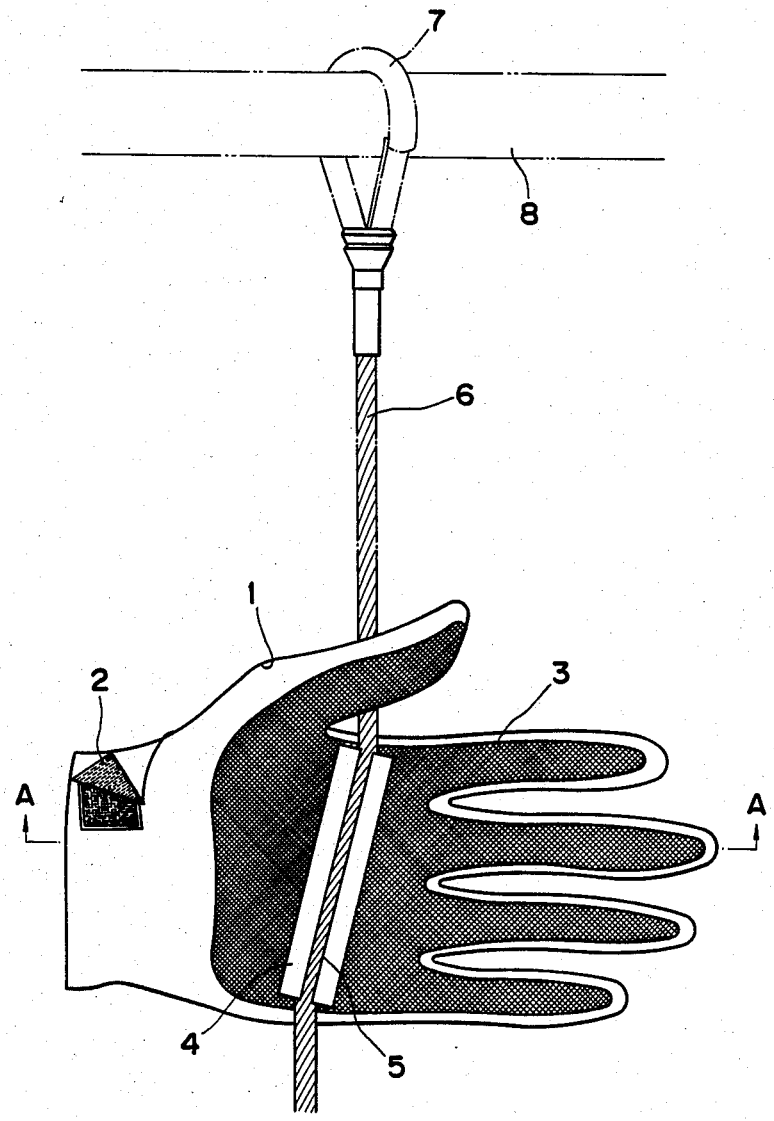
FIG. 1 shows a front view of an embodiment according to the present invention.
Figure 2:
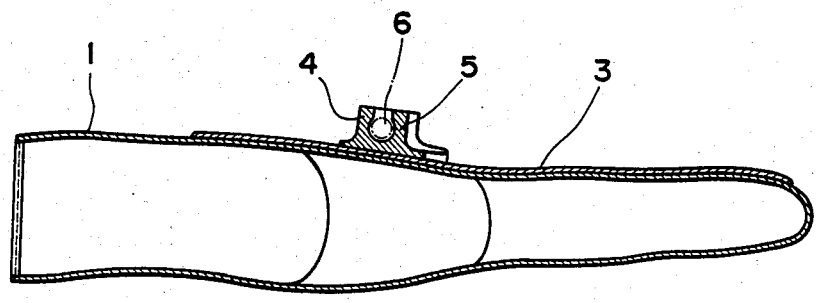
FIG. 2 is a cross-sectional view taken substantially along the line A—A of FIG. 1.

The present invention concerns a pair of escape gloves which are used at a time of emergency such as may occur due to a fire or earthquake requiring immediate exit of the occupants of a building. The purpose is to provide a pair of gloves which enable a person to escape safely to the ground from a building using an escape rope which hangs down an external wall of the building, without leaving a burn or scratch on his hands.

Turning to the drawings, reference numeral 1 indicates generally a glove made of cloth of the type used for ordinary gloves or it may be a cloth made of a heat-resisting fiber or made of leather. A tying band 2 is provided composed, for example, of a "Velcro" type fastener or other suitable fastening means.

A sheet layer 3 composed of a heat-insulating material such as asbestos or glass fibers is secured to the palm of the glove and along the fingers as indicated in FIG. 1.

A guide member 4 is secured substantially in the center of the palm portion of the glove at a slight angle to the lines of the fingers, the guide member 4 having a lateral groove 5 for snugly receiving and engaging with an escape rope 6. The guide member 4 may be made of an elastic rubber or resin having heat and wear resistance.

When an emergency occurs in a building, and its staircases are not able to be used, a person can employ an escape rope 6 which is located along an external wall of the building by fixing one end to a fixed object in the room or by hanging a hook 7 provided in advance at one end of the rope on a handrail 8 as shown in FIG. 1. Then, the rope 6 is snugly fitted into the groove 5 while still permitting relative movement between the two. By controlling the pressure on the guide member 4 through the action of his hands, the user can control the velocity at which the rope 6 slips through the guide members and thus control the velocity of his descent to the ground. The heat-insulating sheet layer 3 provided on the palm of the glove 1 protects the escapee's hands from any burns due to the frictional heat generated between the heat- and wear-resisting guide member 4 and the rope 6, making it possible for the escapee to lower himself safely to the ground without suffering burns on his hands.

The combination of the guide member 4 and the heat-insulating sheet layer 3 can shut off completely the frictional heat which takes place when the escapee slides down the escape rope to the ground.

It should be evident that various modifications can be made to the described embodiments without departing from the scope of the present invention.

We claim as our invention:

1. An escape glove comprising a palm portion having a heat-insulating sheet layer and a wear-resistant elastic guide member attached thereto, said elastic guide member having a lateral groove therein proportioned to receive an escape rope therein, said elastic member being located substantially at the center of said heat-insulating sheet layer.

2. A glove assembly according to claim 1 wherein said layer is composed of asbestos.

3. A glove according to claim 1 wherein said layer includes glass fibers.

4. A glove assembly according to claim 1 wherein said groove is proportioned to receive an escape rope sufficiently snugly to control passage of said rope through said groove by application of pressure by the hand movement of the wearer.

5. The combination of an escape rope and a glove comprising a palm portion having a heat-insulating layer thereon, and an elastic guide member attached thereto, said guide member having a lateral groove therein arranged to snugly receive said rope in sliding relation therethrough, whereby pressure exerted by the hand of the user is effective to vary the pressure on said member against said rope and thereby control relative movement between the two.

6. The combination of claim 5 in which said heat-insulating layer is composed of asbestos.

7. The combination of claim 5 in which said heat-insulating layer includes glass fibers.

* * * * *